US006382728B1

(12) United States Patent
Buono

(10) Patent No.: US 6,382,728 B1
(45) Date of Patent: May 7, 2002

(54) BACK SUPPORT FOR FOLDING SEAT

(75) Inventor: Steven A. Buono, Greenville, TN (US)

(73) Assignee: Meco Corporation, Greenville, TN (US)

( * ) Notice: Subject to any disclaimer, the term of this patent is extended or adjusted under 35 U.S.C. 154(b) by 0 days.

(21) Appl. No.: 09/687,430

(22) Filed: Oct. 13, 2000

Related U.S. Application Data

(63) Continuation-in-part of application No. 09/464,521, filed on Dec. 15, 1999.

(51) Int. Cl.[7] ..... A47C 7/00; A47C 7/02; A47C 27/00

(52) U.S. Cl. ..... 297/440.2; 297/283.3; 297/440.1; 297/452.48; 297/452.55; 297/463.2

(58) Field of Search ..... 297/283.3, 440.1, 297/440.2, 452.48, 452.55, 463.2

(56) References Cited

U.S. PATENT DOCUMENTS

| | | | |
|---|---|---|---|
| 74,910 | A | 2/1868 | Golightly et al. |
| 122,834 | A | 1/1872 | Johnson |
| ,228,662 | A | 6/1880 | Merklen |
| ,275,823 | A | 4/1883 | Hale |
| 1,701,684 | A | 2/1929 | Lee |
| 2,002,118 | A | 5/1935 | Johnson |
| 2,016,385 | A | 10/1935 | Molling et al. |
| D148,391 | S | 1/1948 | Plourde et al. |
| 2,649,140 | A | 8/1953 | Housel |
| 2,649,141 | A | 8/1953 | Marshall et al. |
| 2,650,653 | A | 9/1953 | Gethner |
| D171,610 | S | 3/1954 | Morrison |
| 2,684,709 | A | 7/1954 | Schawinsky |
| D174,592 | S | 4/1955 | Pettibone |
| D193,775 | S | 10/1962 | Werner |
| D206,154 | S | 11/1966 | Bradley |
| 3,780,155 | A | 12/1973 | Byrd et al. |
| D233,102 | S | 10/1974 | Watanabe |
| 3,981,536 | A | 9/1976 | Schultz |
| D256,857 | S | 9/1980 | Tallon |
| D285,874 | S | 9/1986 | McCaffrey |
| D295,239 | S | 4/1988 | Massonnet |
| 4,768,833 | A | 9/1988 | Virtue |
| D317,087 | S | 5/1991 | Frinier |
| D329,546 | S | 9/1992 | Snodgrass |
| D331,505 | S | 12/1992 | Sylvester |
| D333,926 | S | 3/1993 | Hubert |
| D350,653 | S | 9/1994 | Citterio |
| 5,407,248 | A | 4/1995 | Jay et al. |
| D363,826 | S | 11/1995 | Martin |
| 5,478,138 | A | 12/1995 | Yu |
| D368,385 | S | 4/1996 | Grosfillex |
| 5,503,460 | A | 4/1996 | Yu |
| D375,637 | S | 11/1996 | Gustavsen |
| D376,273 | S | 12/1996 | Keller |
| D389,662 | S | 1/1998 | Schwartz |
| D390,028 | S | 2/1998 | Caldwell |
| D396,366 | S | 7/1998 | Swy |
| 5,779,317 | A | 7/1998 | Neal |
| D407,571 | S | 4/1999 | Parmar |
| 5,893,604 | A | 4/1999 | Yao |

*Primary Examiner*—Peter M. Cuomo
*Assistant Examiner*—Joseph Edell
(74) *Attorney, Agent, or Firm*—Roberts, Abokhair & Mardula, LLC

(57) ABSTRACT

According to one aspect of the folding chair of the present invention, a seat back support integrally formed with the front legs of the folding chair is bent forward at a particular angle, at a particular height above the seating surface, to provide comfortable lower back support for a person sitting on the seat, while maintaining stability. According to another aspect of the invention, a cushion for use on the seat back of the chair is disclosed. The cushion has a particular shape with portions that are intended to interlock with a correspondingly shaped apertures in the seat back of the chair. The cushions may be removed for cleaning or replacement with little trouble. In another aspect, the seating surface of the folding chair is contoured with a gentle s-shape.

12 Claims, 15 Drawing Sheets

BACK SUPPORT FOR FOLDING SEAT

RELATIONSHIP TO OTHER APPLICATIONS

This application is a continuation-in-part of co-pending U.S. application Ser. No. 09/464,521, filed Dec. 15, 1999 still pending.

FIELD OF THE INVENTION

The present invention relates generally to furniture. More particularly, the present invention is related to a folding seat with an ergonomic back support, ergonomic seat, and/or cushion for interlocking with the back support.

BACKGROUND INFORMATION

A long-standing challenge to the furniture industry has been how to make a folding seat (i.e., chair or stool) that is both comfortable and stable, yet folds into a compact configuration.

Folding stools with round seats are known. Examples of such round seat folding stools are disclosed in U.S. Pat. Nos. 5,478,138 and 5,503,460, both issued to Yu. Another example of a prior art folding stool is disclosed in U.S. Pat. No. 5,893,604, issued to Yao. Each of these prior art folding stools suffers from the common deficiency that they do not have a structure for providing back support to a seated person. These stools make a straightforward sacrifice of comfort for the sake of compactness when folded.

The folding stools disclosed in U.S. Pat. No. 2,649,140 to Housel and in U.S. Pat. No. 2,002,118 issued to Johnson, each have a structure which projects above the seat. However, in each case, the structure projecting above the seat is merely a handle, and cannot be considered to have any functionality whatsoever as providing back support. Again, these stools represent a sacrifice of comfort for the sake of compactness when folded.

U.S. Pat. No. Des. 256,857 issued to Tallon, shows an ornamental design for a folding chair having a round seat. A back support structure is portrayed. The right side elevation view (see FIG. 4) reveals that the back support structure angles away from the seat at an extreme angle. Thus, it is apparent that the back support structure of the Tallon ornamental design has little functional value.

The folding chair disclosed by U.S. Pat. No. 2,016,385 issued to Molling, shows a back support structure bent at an angle (See FIG. 1 of Molling). The apparatus disclosed by Molling has the disadvantages that the back support is very tall, and thus, not compact, and that the folding mechanism beneath the seat is very complex.

The folding chair disclosed by U.S. Pat. No. 2,650,653 issued to Gethner, shows a back support structure which has a bend between the seat and the back pad. However, the angle of the bend is quite large, so as to result in a folding chair which cannot fold very flat.

Thus, what is needed is a compact folding seat that provides useful back support, is stable, and which can be folded flat.

With few exceptions, the back cushions of chairs have been permanently attached to the frame of the chair. Although seat cushions of chairs are often removable (for cleaning, etc.), back cushions (in any are provided) are generally not removable.

U.S. Pat. No. 5,407,248 to Jay et al. shows a wheel chair back that has a plurality of modular, removable square foam blocks. The blocks are held onto the chair back by VELCRO™ strips, and are selectively removable so as to customize the contour of the wheel chair to accommodate for deformities of the chair occupant. Wedge shaped cushions may optionally be fitted in place of the regular cushions so as to provide for a moderate sloping contour. Although this chair back is useful for preparing a seating profile customized to a particular occupant, it does not lend itself to efficient mass production. For example, the use of VELCRO™ permits too much variability in the back cushion configuration for mass market chairs.

U.S. Pat. No. 5,779,317 to Neal shows a folding chair that has interchangeable components. An interchangeable seat mates to the seat of the chair by interlocking with a locator member. The interchangeable back mates to the back of the chair by interlocking with another locator member. Although both the back cushion and the seat cushion are removable and replaceable in this chair, the fastening system is complex.

Accordingly, what is also needed is a back cushion system for a chair that permits the back cushions to be freely removed and interchanged, yet provides a simple way of fixing the cushions to the chair that provides for reliably consistent positioning of the cushions.

SUMMARY OF THE INVENTION

It is an object of the present invention to provide a folding seat that is compact and which folds flat.

It is another object of the present invention to provide a folding seat that provides useful back support, while at the same time, being compact and being capable of folding flat.

It is yet another object of the present invention to provide a folding seat that is stable and provides ergonomically back support, while at the same time, being capable of folding flat.

It is still another object of the present invention to provide a chair with a back cushion that is freely removable and interchangeable.

It is also an object of the present invention to provide a chair with a back cushion that is fixed to the back of the chair in a simple manner.

It is a further object of the present invention to provide a chair with a back cushion that is interlocked to holes in the back of the chair.

It is a still further object of the present invention to provide a chair with back cushions that are fixed to the back of the chair at consistent positioning.

It is yet another object of the present invention to provide a cushion with elements having a circumferential channel for use in interlocking with a hole in the back of a chair.

Some of the above objects of the invention are achieved by a device for supporting a seated person above the ground, which has a means for supporting the buttocks of the seated person, a means for holding the means for supporting the buttocks at a predetermined distance above the ground, and a means, connected to the means for holding, for supporting the lower back of the seated person. The means for supporting the lower back comprises back support tubing which is bent at a predetermined angle at a predetermined height above the means for supporting the buttocks.

Some of the above objects are achieved by a chair that has a seat and a back connected to the seat, the back having a support frame and a cushion. The support frame has a grid configuration with plural holes being formed therein according to the grid configuration. The cushion has elements that are fitted into at least one of the plural holes so as to be interlocked to the back of the chair.

Other of the above objects are achieved by an interlocking cushion for use with a chair back. The cushion has a body formed of springy material (such as foam rubber, for example), the body or elements thereof having a circumferential groove. The circumferential groove provides an interlocking fit with a hole formed in the chair back.

Some of the above objects are also achieved by an interlocking cushion for use with a chair back, where the cushion has a body formed of springy material, the body being divided into a main portion and plural interlock portions. The main portion has a substantially flat back and the plural interlock portions are disposed on the back of the main portion. Each of the interlock portions provides an interlocking fit with a corresponding hole formed in the chair back.

According to one aspect of the present invention, cushions are provided for use on the backs of chairs, and those cushions may be easily removed from the chair backs and interchanged with other cushions. Each of the cushions has a particular shape that is intended to interlock with a correspondingly shaped hole in the back of a chair.

According to another aspect of the present invention, the back of the chair is bent at a predetermined angle at a predetermined height above the seat.

BRIEF DESCRIPTION OF THE DRAWINGS

Additional objects and advantages of the present invention will be evident in the following detailed description, read with reference to the attached drawing figures.

DETAILED DESCRIPTION OF THE PREFERRED EMBODIMENT

Folding seats according to the present invention encompass stools and chairs that have an ergonomic back support, and that fold compactly for storage.

A stool according to an embodiment of the present invention is unique in the art of compact stools because it provides a back support structure. Even more unique is the fact that the back support structure on the compact stool embodied according to the present invention provides usable, ergonomically correct back support for the lower back.

In expanding the utility of a foldable stool to include back support, it is important not to lose the compact nature of a folding stool by bending the support structures at extreme angles. If a support structure is bent too sharply, then the resulting stool will not effectively fold into a compact, more or less flat structure for storage using a minimum space. Another factor to consider, when modifying a compact stool to have a structure that supports the back of a seated person, is that the back support structure should not be so tall as to defeat the compact nature of the stool by causing it to take up too much storage space.

A chair according to another embodiment of the present invention is unique in the art of folding chairs because it provides an angled, ergonomically advantageous back support structure. The back support structure of a folding chair embodied according to the present invention provides usable, ergonomically correct support for the lower back.

Discovery of particularly advantageous dimensions for the back support provide for unexpectedly comfortable seating without sacrificing compact folding functionality. As the back support structure rises above the seat, an upper portion of the back support bends forward. The height above the seat at which the bend occurs and the angle of the bend, it turns out, are important factors.

Another aspect of the present invention is cushions for use on the backs of chairs, and how those cushions are combined with the chair backs. Each of the cushions has a particular shape that is intended to interlock with a correspondingly shaped hole in the back of a chair.

The cushions are shaped so as to have a circumferential channel that divides the cushion into a front portion and a back portion. The cushion is sufficiently elastically deformable so that the cushion may be compressed to fit into a hole on the back of a chair. When compressed into the hole in the chair back, the cushion is then decompressed when the front portion is on the front side of the chair back and the back portion is on the back side of the chair back. The elastic main body of the cushion is preferably formed of a foamed polymer.

Figure 1:
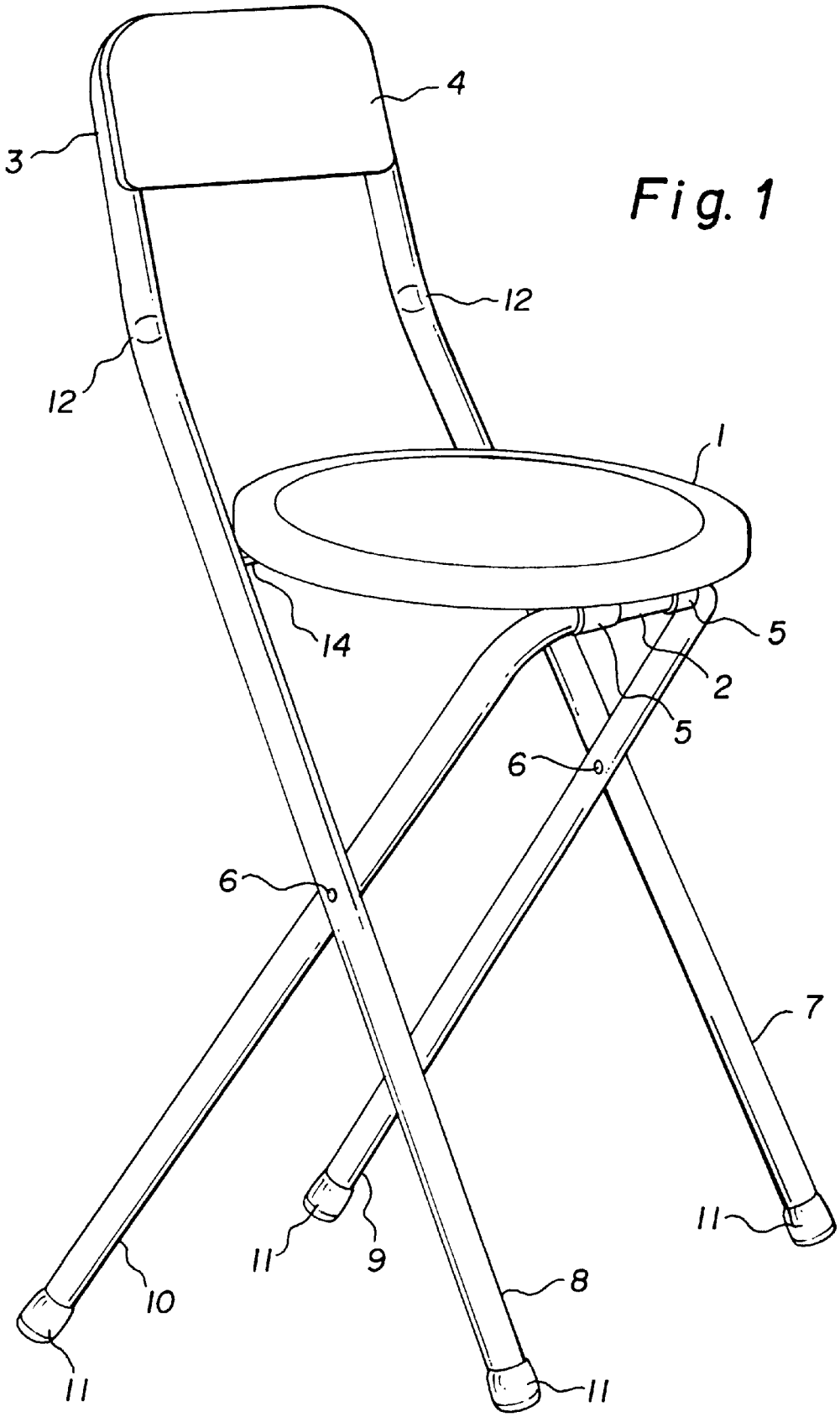
FIG. 1 illustrates a perspective view of an embodiment that incorporates the bend aspect of the present invention.

Referring to FIG. 1, the main element of the folding stool embodiment is a seat 1. The seat 1 is preferably formed of injection molded polymer, however, wood is a good alternate material for forming the seat 1. An inner U-shaped support 2 and an outer U-shaped support 3 directly support the seat. The inner U-shaped support 2 fastens to the underside of the seat 1 via a pair of brackets 5. The outer U-shaped support 3 is connected to the underside of the seat 1 by a support rod 14 and a pair of rod retainers 13 (refer to FIGS. 2–4), which are part of the brackets 5. The inner U-shaped support 2 and the outer U-shaped support 3 are pivotably connected to one another by means of pivot fasteners 6. The pivot fasteners 6 are preferably embodied as push rivets.

The inner U-shaped support has a left leg portion 9 extending downward from the seat and having an end cap 11 fastened at its extreme lower end. Likewise, the right leg 10 of the inner U-shaped support extends downward from the seat 1 to an extreme lower end having an end cap 11.

The outer U-shaped support 3 has a left leg 7 which extends from a lowest portion having an end cap 11 up past the fastener 6 and extending above the seat 1 to a bend 12. Likewise, the right leg 8 of the outer U-shaped support 3 extends upwardly from an end having an end cap 11, past fastener 6, and extending above the seat 1 to a bend 12. Above the bends 12, the outer U-shaped support has a back rest 4 attached to its extreme upper end. Like the seat 1, the back support 4 is preferably formed of injection molded polymer, however it is also advantageously embodied as being formed of wood. The end caps 11 are preferably formed of a resilient polymer.

Figure 2:
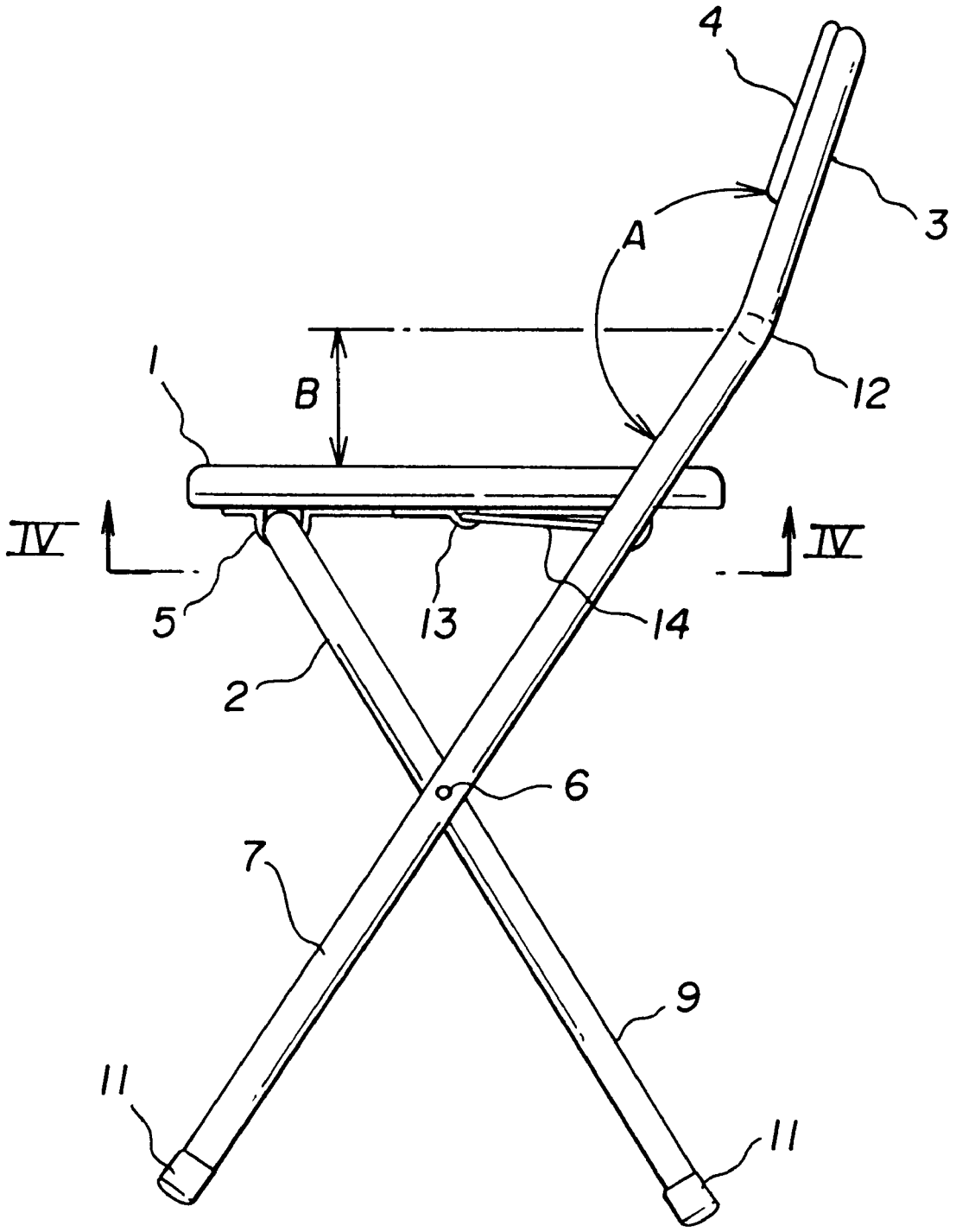
FIG. 2 illustrates an elevation view of the embodiment shown in FIG. 1.

Referring to FIG. 2, the advantageous arrangement of the bend 12 of the outer U-shaped support 3 is illustrated. The dimension B indicates the height of the bend 12 above the seat 1 (when the stool is in its unfolded configuration). For adult-size furniture, dimension B should be greater than about 2.5 inches, yet less than about 4.1 inches. Most preferably, dimension B should be about 3.3 inches for adult-size furniture. In the case of children's furniture, dimension B may advantageously be made smaller, in proportion to the decrease of other dimensions of the stool, in order to accommodate the smaller bodies of children comfortably and stably.

The angle of the bend 12 indicated by angle A, is preferably in the range of about 160° to about 170°. Most preferably, the angle A is about 165°.

The dimension B and the angle A are important factors for embodying a folding stool which is ergonomically correct, comfortable, and stable, and which will fold relatively flat. If the bend 12 is made at a height too high above the seat 1, the result is a stool that causes the seated person to lean back too far and results in instability. The seated person is said to be leaning too far back if his or her center of gravity approaches (or, in the failure mode, moves behind) the vertical plane passing through the points where the rear legs contact the floor. When the seated person's center of gravity approaches or moves behind that vertical plane there is a substantial danger of the stool tipping over.

Conversely, if the bend 12 is located too low, (i.e., too close to the seat 1) then the user cannot comfortably use the entire seat while at the same time using the backrest. This is an uncomfortable result. It is important to keep in mind that one of the objects of a compact stool is that it be small in size. As a result, the seat itself is kept to minimal dimensions. Thus, the placement of the backrest 4 is important so as to allow the seated individual to use as much of the seat 1 as possible.

It is also important to keep the bend angle A from being too large, so that when the folded stool is in a folded configuration, that it does not deviate significantly from a flat profile. This is important so that the folding stool maintains a compact nature, and does not take up an undue amount of space when folded away for storage.

Figure 3:
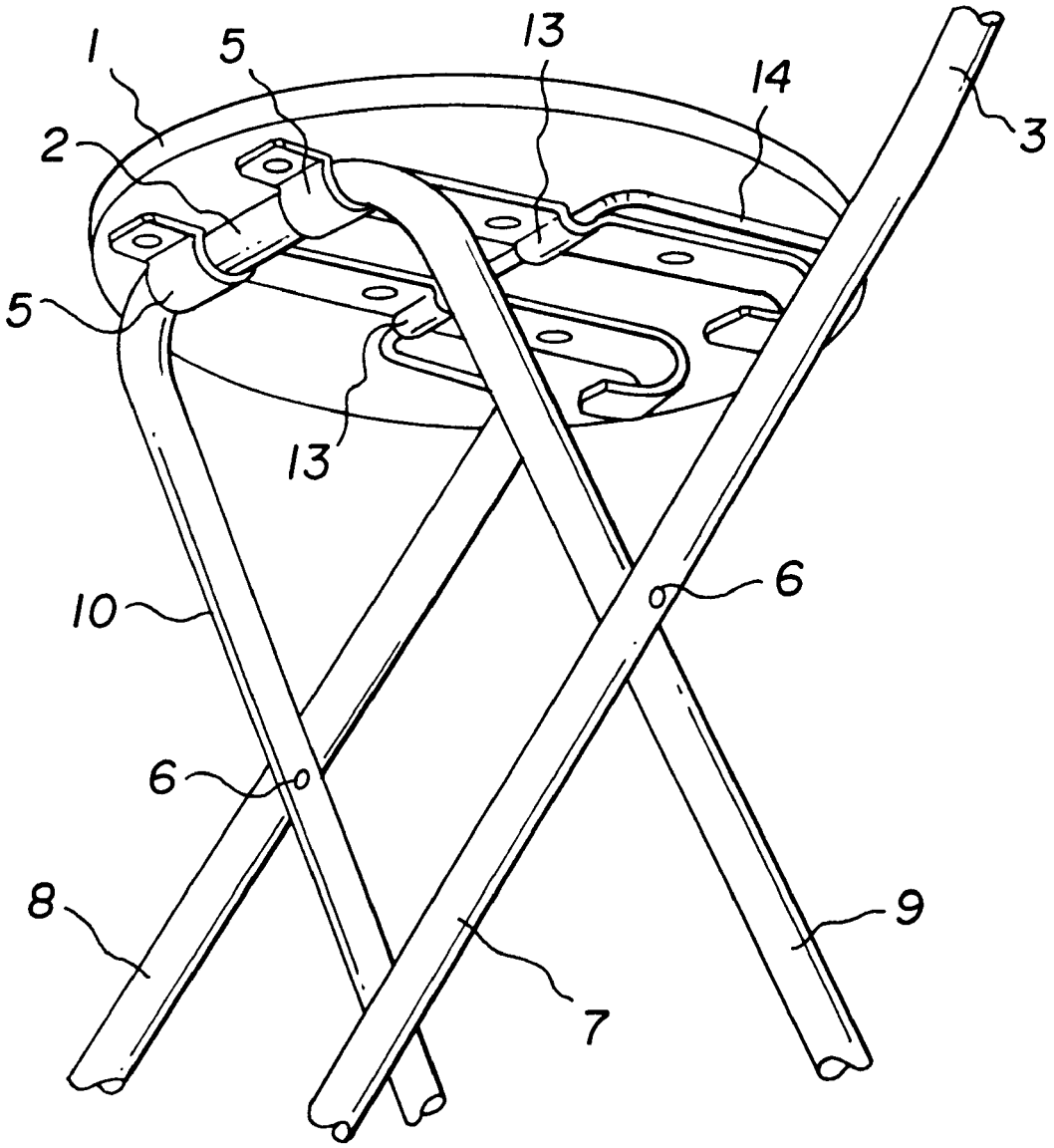
FIG. 3 illustrates a detail view (in perspective) of the underside of the seat according to the embodiment shown in FIG. 1.
Figure 4:
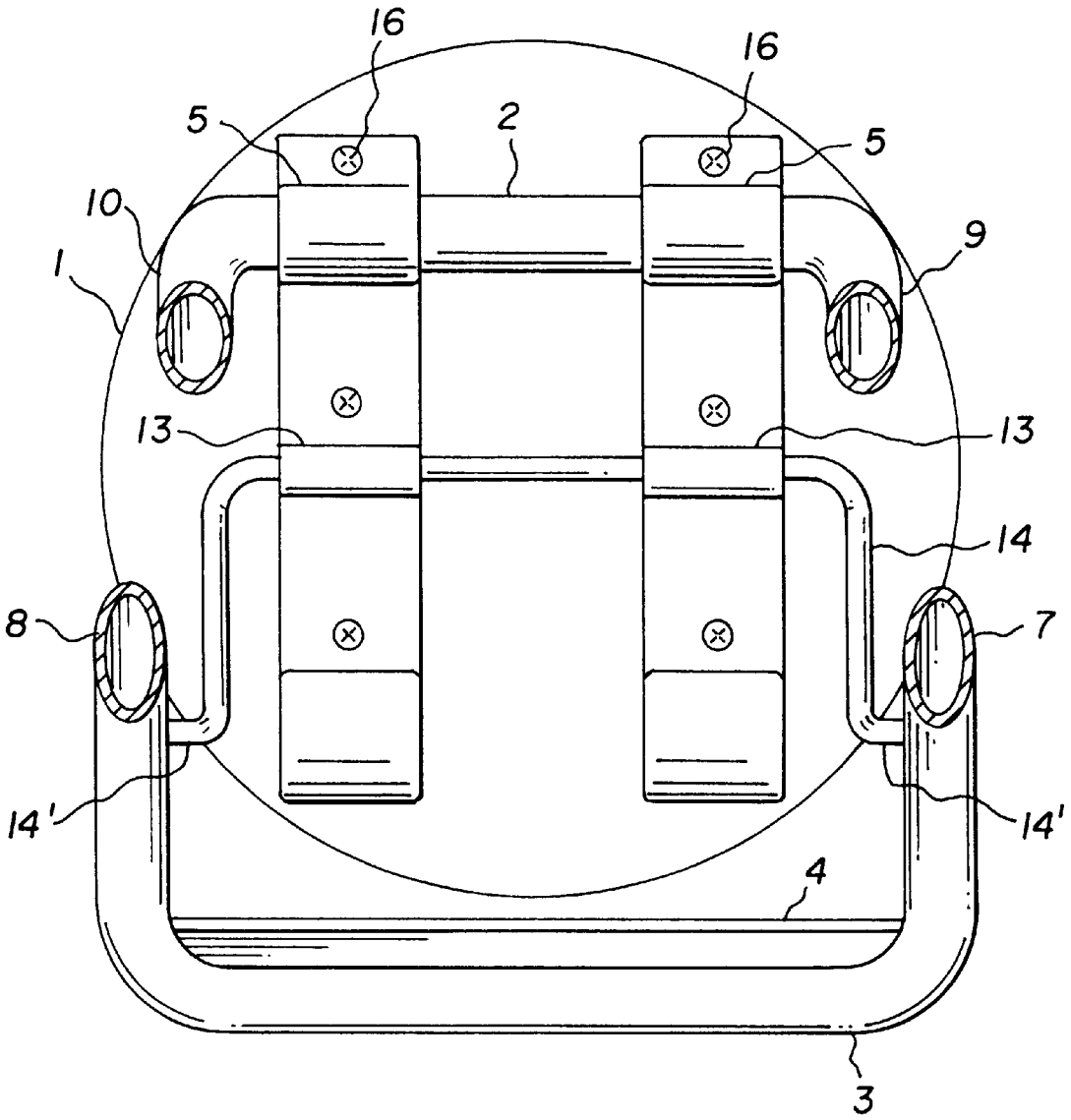
FIG. 4 illustrates a cross -sectional view of an embodiment of the present invention, the view being taken along the section line IV—IV in FIG. 2.

Referring to FIG. 3, the details of the U-shaped supports 2, 3 are connected to the seat 1 via the brackets 5 are illustrated via a perspective view. The brackets 5 are formed of either metal (such as steel) or a polymer resin. Referring to FIG. 4, the details of the U-shaped supports 2, 3 are connected to the seat 1 via the brackets 5 are illustrated via a cross-sectional view taken along the section line IV—IV in FIG. 2. The inner U-shaped support 2 is secured to the bottom of the seat 1 by the front portions of each of the brackets 5. The inner U-shaped support 2 is free to pivot with respect to the brackets 5. In the unfolded configuration (as shown), the support rod 14 lies directly against the underside of the seat 1. A central portion of the support rod 14 is secured to the bottom of the seat 1 via the rod retainers 13 portion of the brackets 5. The support rod 14 is free to pivot with respect to the rod retainers 13. The ends 14' of the support rod 14, are inserted into each of the leg portions 7, 8 of the outer U-shaped support 3. The ends 14' of the support rod 14 are free to rotate with respect to the legs 7, 8.

The brackets 5 are each fastened to the bottom of the seat 1 by fasteners 16. The fasteners 16 are illustrated as being Philip's head screws, however, any other conventional fastening scheme may be utilized.

According to this preferred configuration, the folding action for the stool is for the rear portion of the seat 1 to move upwardly away from the ends 14' of the support rod 14. At the same time the inner U-shaped support 2 pivots with respect to the front portion of the brackets 5, and the support rod 14 rotates with respect to the rod retainers 13. The inner U-shaped support 2, pivoting at the fasteners 6, rotates into alignment with the outer U-shaped support 3. The seat 1 rotates into the folded configuration (not shown) such that the seat 1 rests substantially flat against the outer U-shaped support 3.

Figure 5:
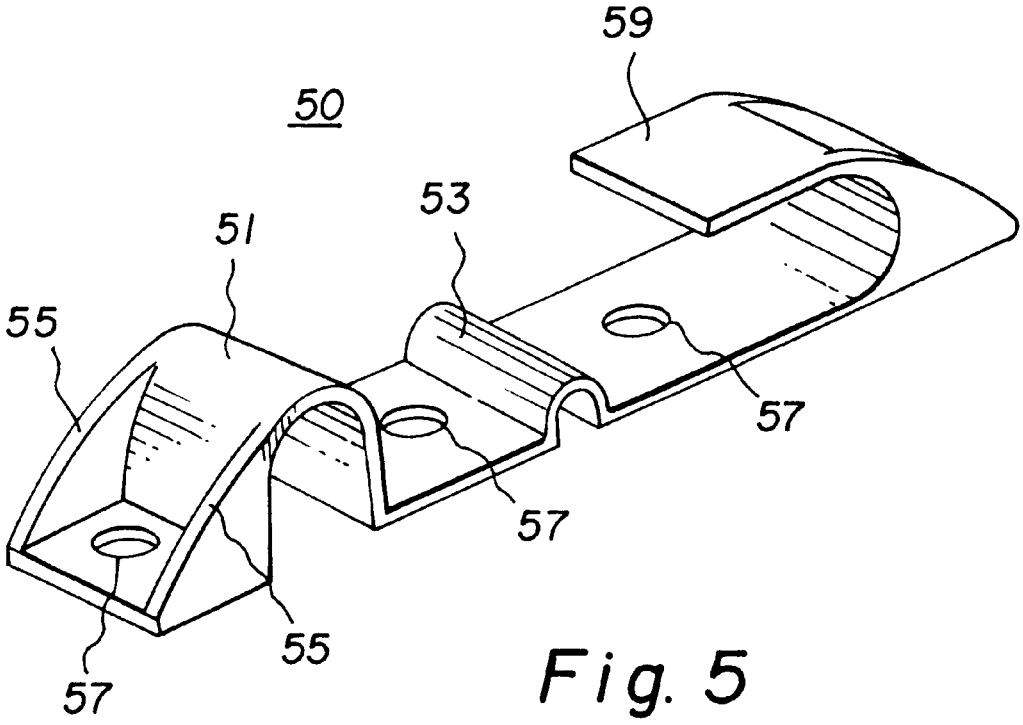
FIG. 5 illustrates a bracket according to an alternate embodiment of the present invention.

Referring to FIG. 5, a bracket 50 according to an alternate embodiment is illustrated. At the front of the bracket 50, a large U-shaped retainer 51 is formed for holding the inner U-shaped support 2. In the middle of the bracket 50, a small U-shaped retainer 53 is formed for holding the support rod 14. Holes 57 are disposed along the bracket 50 for engaging a fastener to fasten the bracket 50 to the underside of the seat 1. The holes 57 may be formed with counter sinks or counter bores to suit a selected fastener. At the back of the bracket 50 is a hook-shaped portion 59, which has no useful purpose in the context of the present invention. The hook-shaped portion 59 is included on the bracket 50 merely as a manufacturing expedient and may be eliminated without loss of function.

The salient difference between the bracket 50 of the FIG. 5 embodiment and the bracket 5 as illustrated in FIGS. 1–4 is the buttress structures 55, which are adjacent to the large U-shaped retainer 51. The buttresses 55 are not necessary to the practice of the invention, but their use is preferred because they add mechanical strength to the bracket 50.

Figure 6:
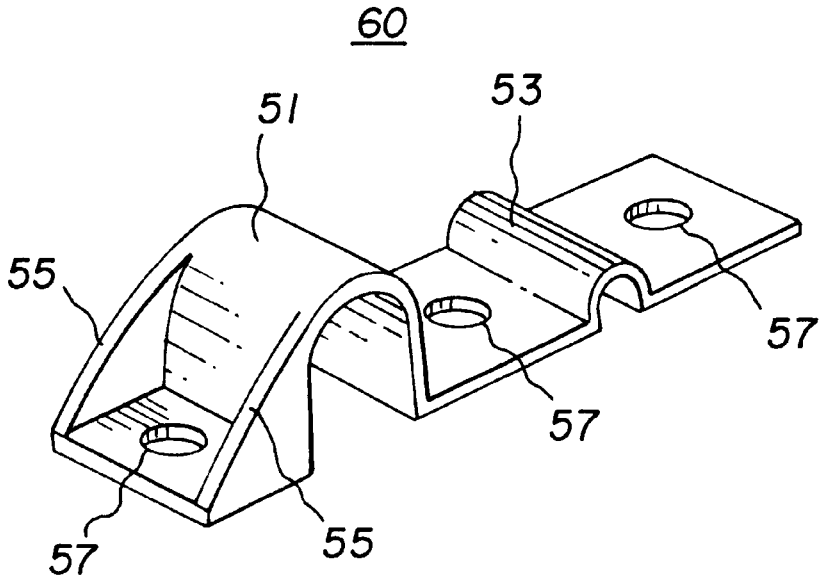
FIG. 6 illustrates a bracket according to another alternate embodiment of the present invention.

Referring to FIG. 6, a bracket 60 according to another alternate embodiment is illustrated. The bracket 60 according to this alternate embodiment is the same as the bracket 50 illustrated in FIG. 5, except for the omission of the hook-shaped portion 59.

In the preferred embodiment, the stool seat 1 is shown as being round. However, the precise shape of the stool seat 1 is not critical, and the seat may be embodied in the shape of any regular or irregular polygon or even free-form shapes.

The inner and outer U-shaped supports 2, 3 have been portrayed in the described embodiments as being tubular with round cross-sections. However, other cross-sections may advantageously be used, such as square tubing. It is preferable to form the U-shaped supports 2, 3 out of steel.

Figure 7:
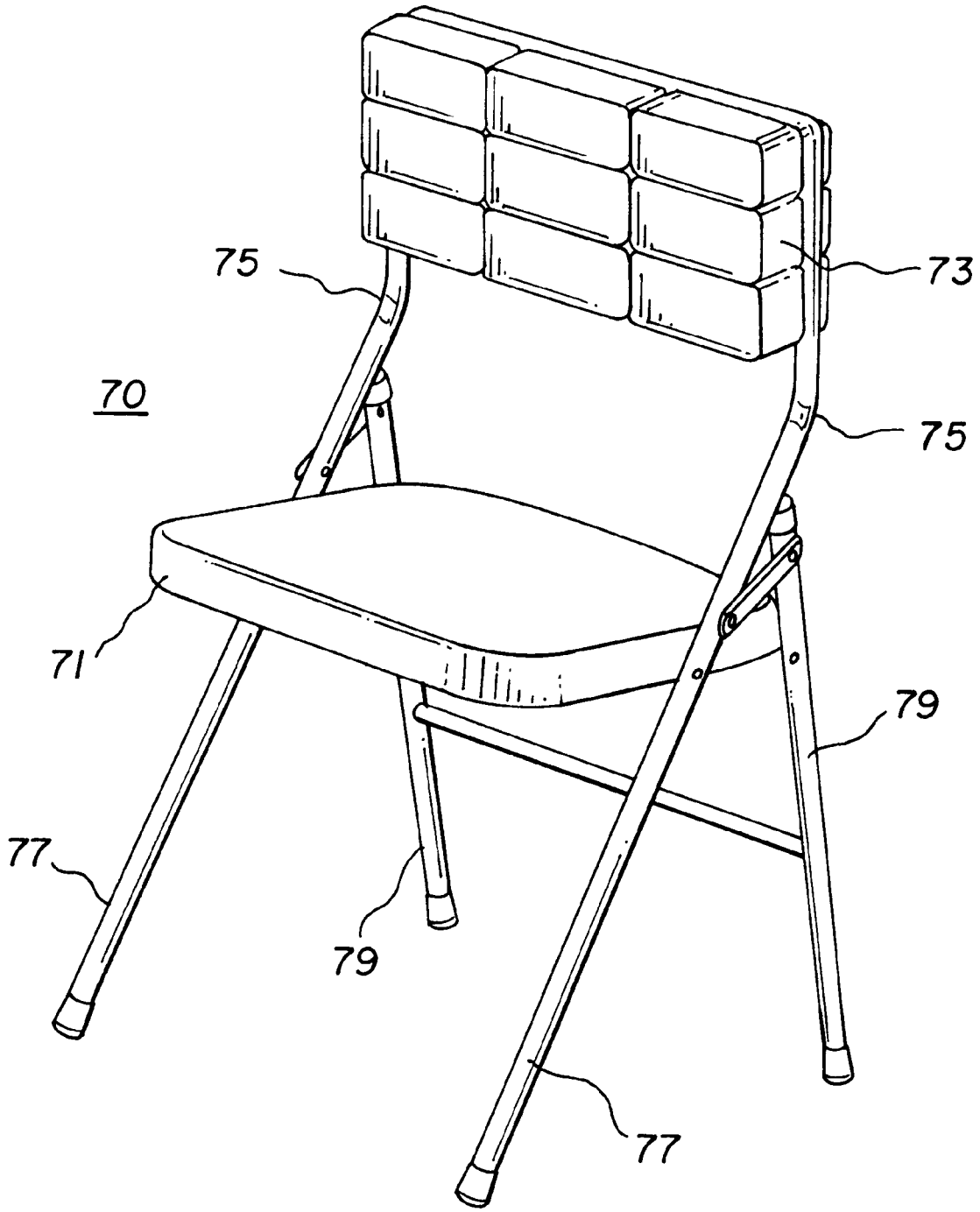
FIG. 7 illustrates a perspective view of an embodiment that incorporates both the bend and interlocking aspects of the present invention.

Referring to FIG. 7, an embodiment of the present invention as a folding chair 70 that incorporates both the bend and interlock cushion aspects of the present invention is illustrated. The chair 70 has a seat 71 and a back 73. The back 73 has bends 75 with similar characteristics to the bends described above regarding the stool embodiment, and it has cushions as will be described in detail below. The back of the chair 70 extends downward into a pair of front legs 77 extending substantially in parallel with one another. The chair 70 also has a pair of back legs 79 that extend downward from the back 73 substantially in parallel with one another. This configuration provides for enhanced back support function without sacrificing the ability to fold the chair into a compact configuration for storage.

Figure 8:
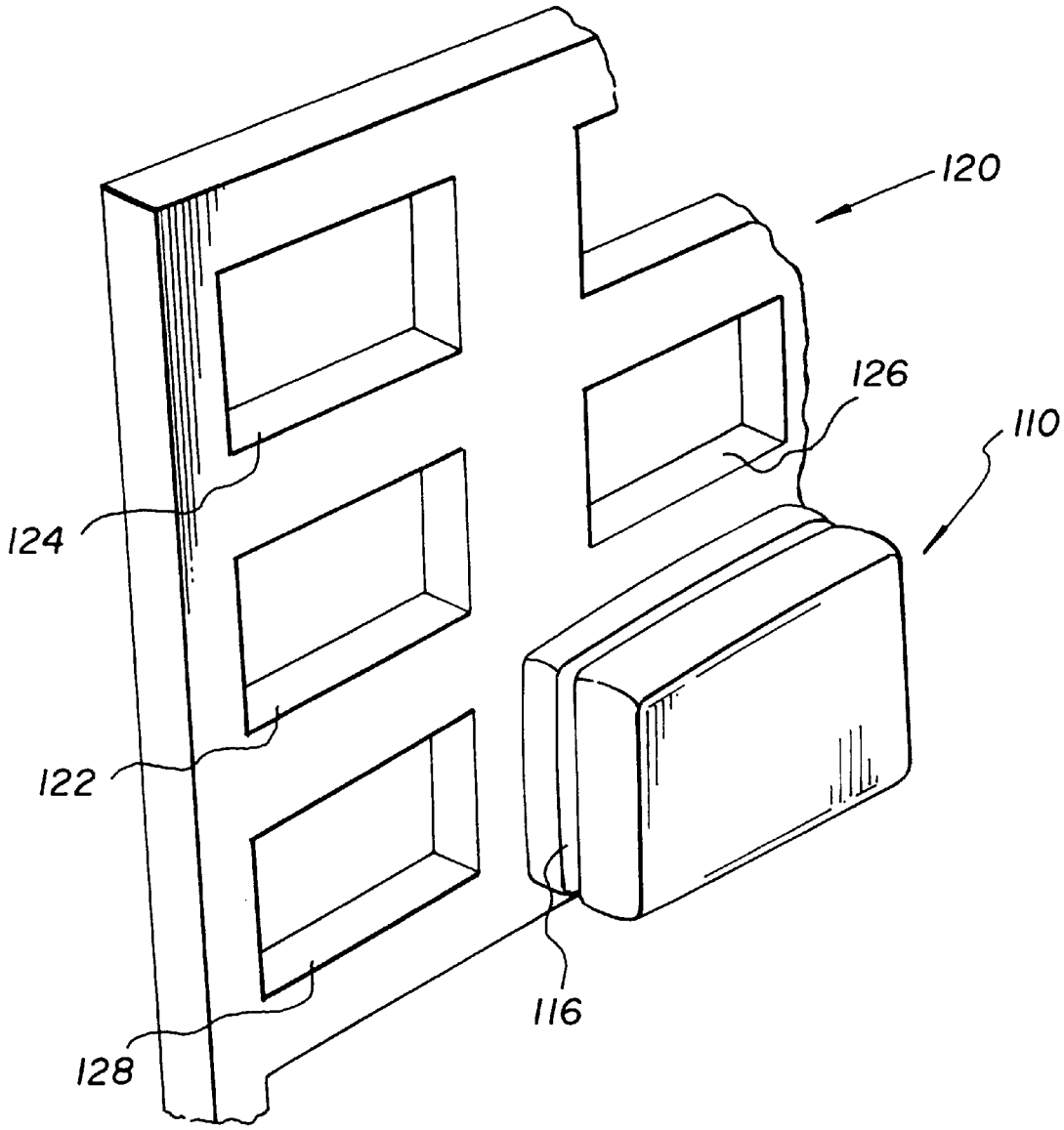
FIG. 8 illustrates an exploded view of a cushion and chair back according to an embodiment of the present invention.

Referring to FIG. 8, a cushion 110 has a circumferential channel 116. Each cushion is fastened to a chair back 120 by fitting the cushion 110 into a hole 122 in the chair back so that the circumferential channel 116 interlocks with the inner periphery of the hole 122 in the chair back 120.

Figure 9:
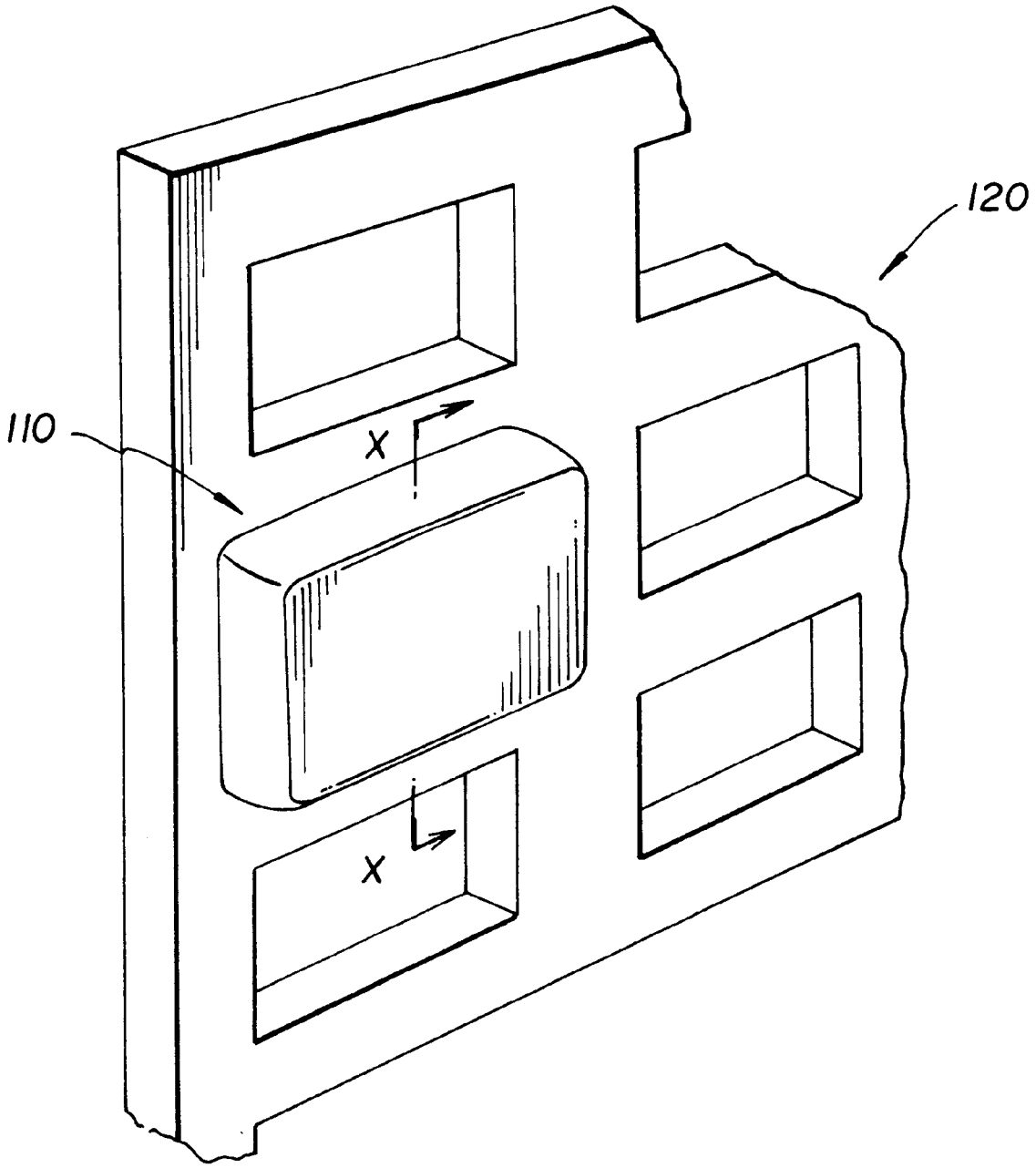
FIG. 9 illustrates a perspective view of the assembled combination of a cushion and chair back according to an embodiment of the present invention.

Referring to FIG. 9, the assembled combination of the cushion 110 and the chair back 120 is shown. For clarity only a single cushion is portrayed as being assembled to the chair back. As is evident from further description, the present invention is preferably embodied such that each of the holes 122, 124, 126, 128 in the chair back 120 is assembled with a respective cushion.

Figure 10:
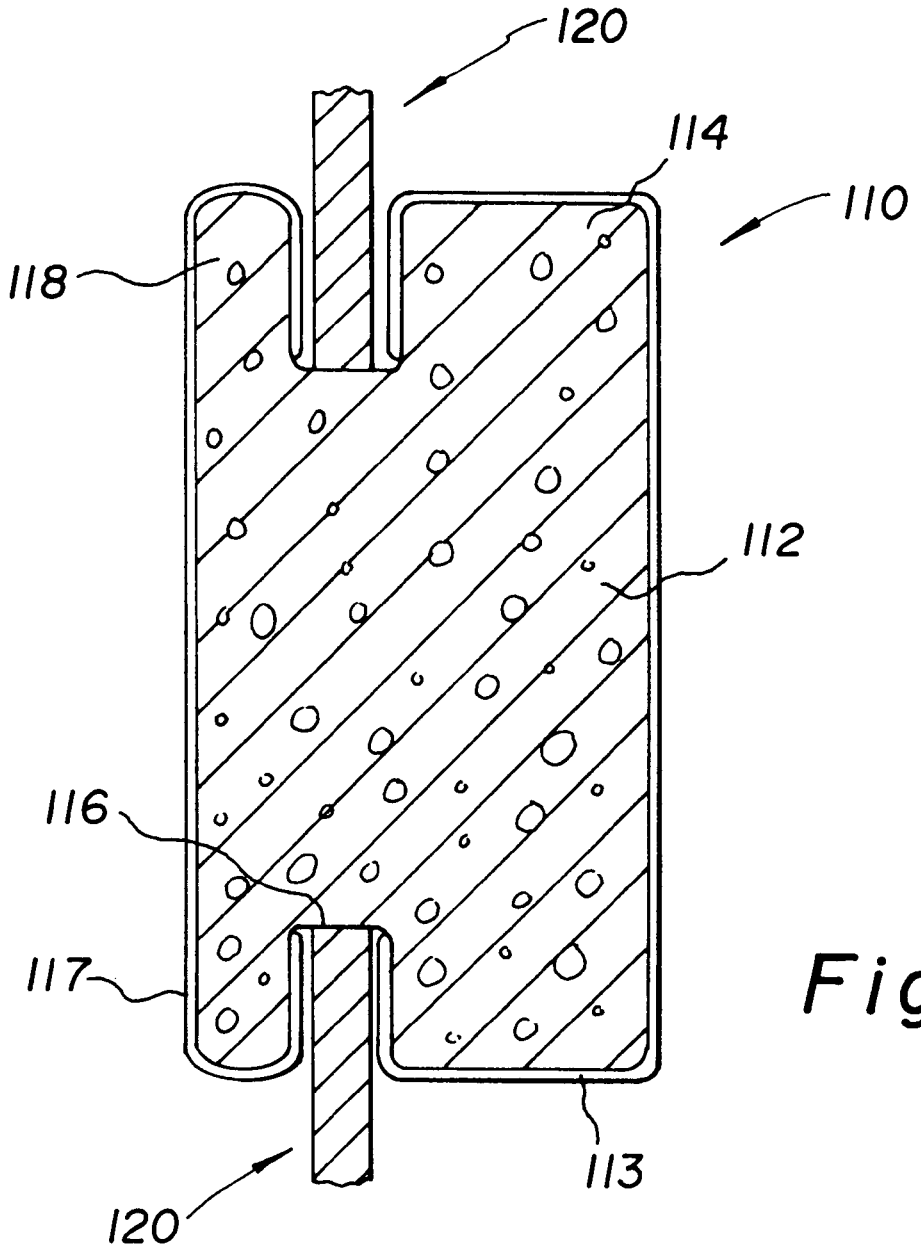
FIG. 10 illustrates a cross sectional view of the assembled combination of a cushion and a chair back taken along the section line in FIG. 9.

Referring to FIG. 10, this interlocked configuration is shown in cross section. The circumferential channel 116 defines a front portion 114 and a back portion 118 of the foam body 112. The front portion 114 is covered by a front cover 113 and the back portion 118 is covered by a back cover 117.

The front cover 113 and the back cover 117 may be formed of any suitable flexible material. It is preferred that the covers be made from a textile material. Leather or sheet polymer are other examples of suitable materials for the covers 113, 117.

Figure 11B:
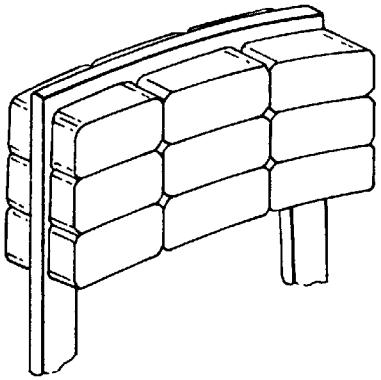
FIG. 11B illustrates a perspective view of a chair back according to a first alternate embodiment of the present invention.
Figure 11D:
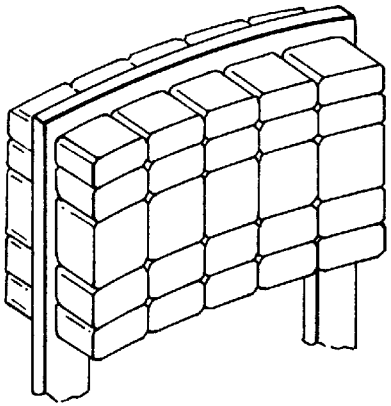
FIG. 11D illustrates a perspective view of a chair back according to a third alternate embodiment of the present invention.
Figure 11A:
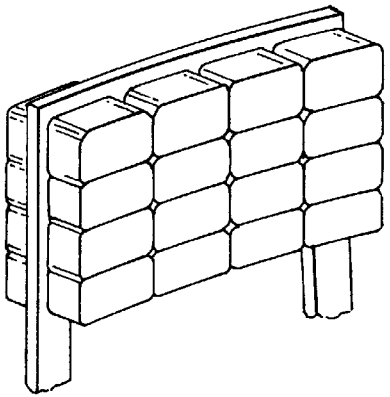
FIG. 11A illustrates a perspective view of a chair back according to one embodiment of the present invention.
Figure 11C:
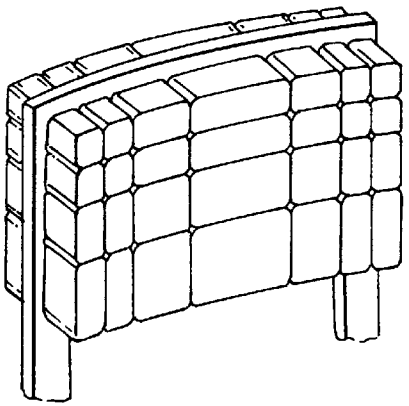
FIG. 11C illustrates a perspective view of a chair back according to a second alternate embodiment of the present invention.

The number of cushions per seat back, the shape of the cushions, and their pattern of arrangement is varied according to different embodiments. Referring to FIGS. 11A–11D, various embodiments are illustrated where the cushions have rectangular shapes. FIG. 11A shows an embodiment that uses a regular 4×4 matrix of rectangular cushions. FIG. 11B shows a first alternate embodiment that uses a regular 3×3 matrix of rectangular cushions. In the second alternate embodiment illustrated in FIG. 11C, the height and width of the cushions is varied both horizontally and vertically along the chair back. According to the third alternate embodiment illustrated in FIG. 11D, the height of the cushions is varied vertically along the chair back, whereas the width of the cushions remains regular.

Figure 12B:
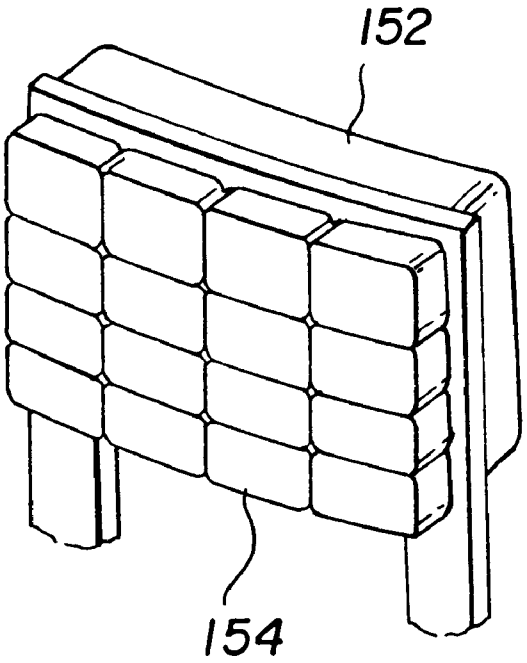
FIG. 12B illustrates a perspective view of the back of a chair back according to the fourth alternate embodiment of the present invention.
Figure 12A:
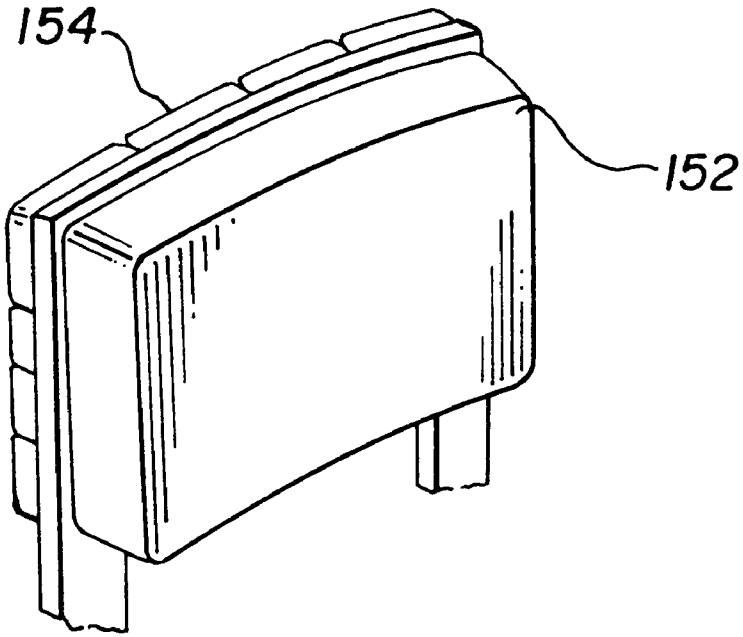
FIG. 12A illustrates a perspective view of the front of a chair back according to a fourth alternate embodiment of the present invention.

Referring to FIGS. 12A & 12B, a fourth alternate embodiment is shown, which has a single large rectangular front portion 152 to the cushion and has plural rear portions 154. Each of the plural back portions 154 fits through a respective hole in the seat back.

An additional feature according to the present invention is to incorporate a cushion as described above on the seat also. The configuration according to FIGS. 12A & 12B is preferred for implementing an interlock cushion on the chair seat.

Figure 13A:
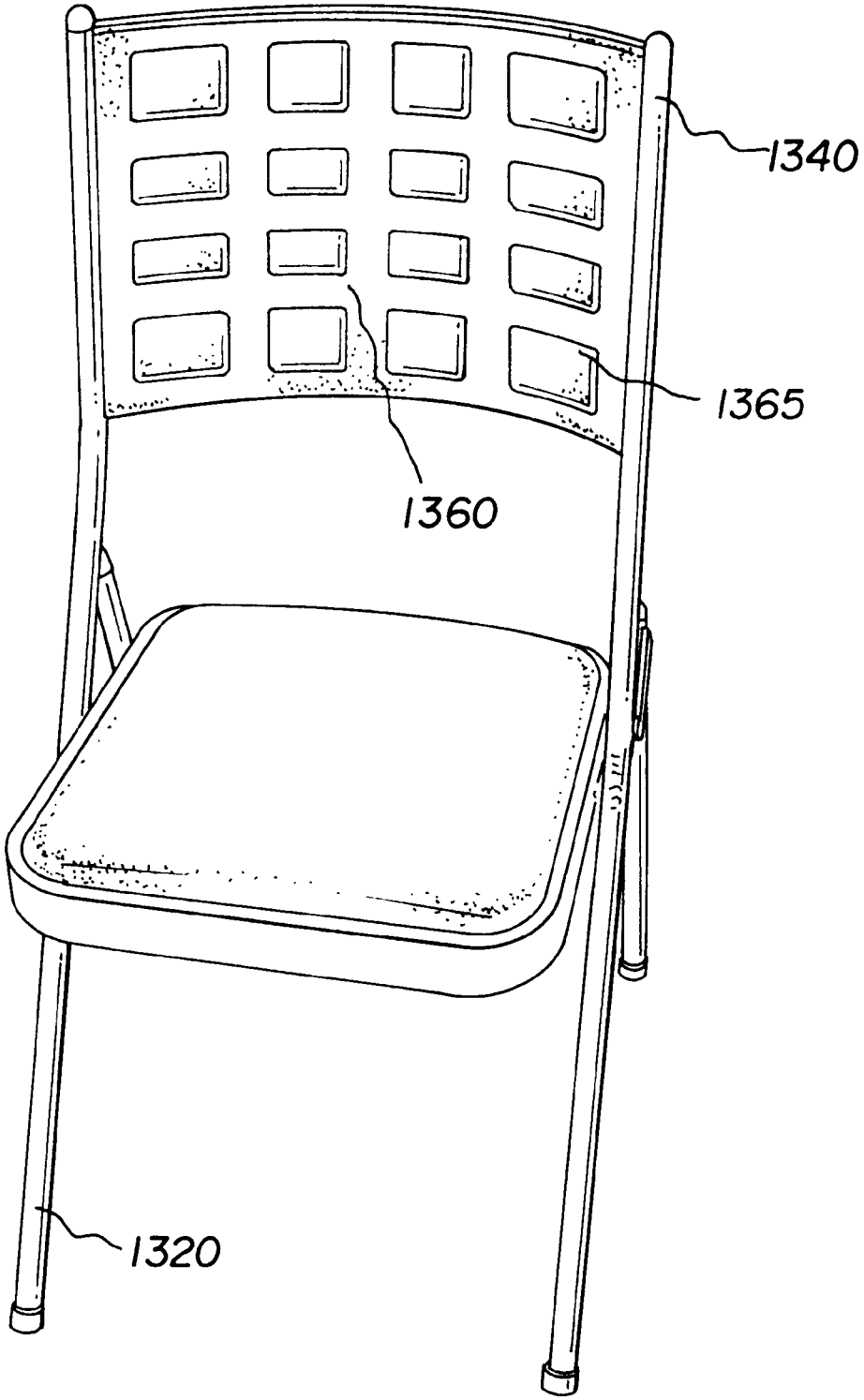
FIG. 13A illustrates a perspective view of the front of a cushioned chair according to another embodiment of the present invention.
Figure 13B:
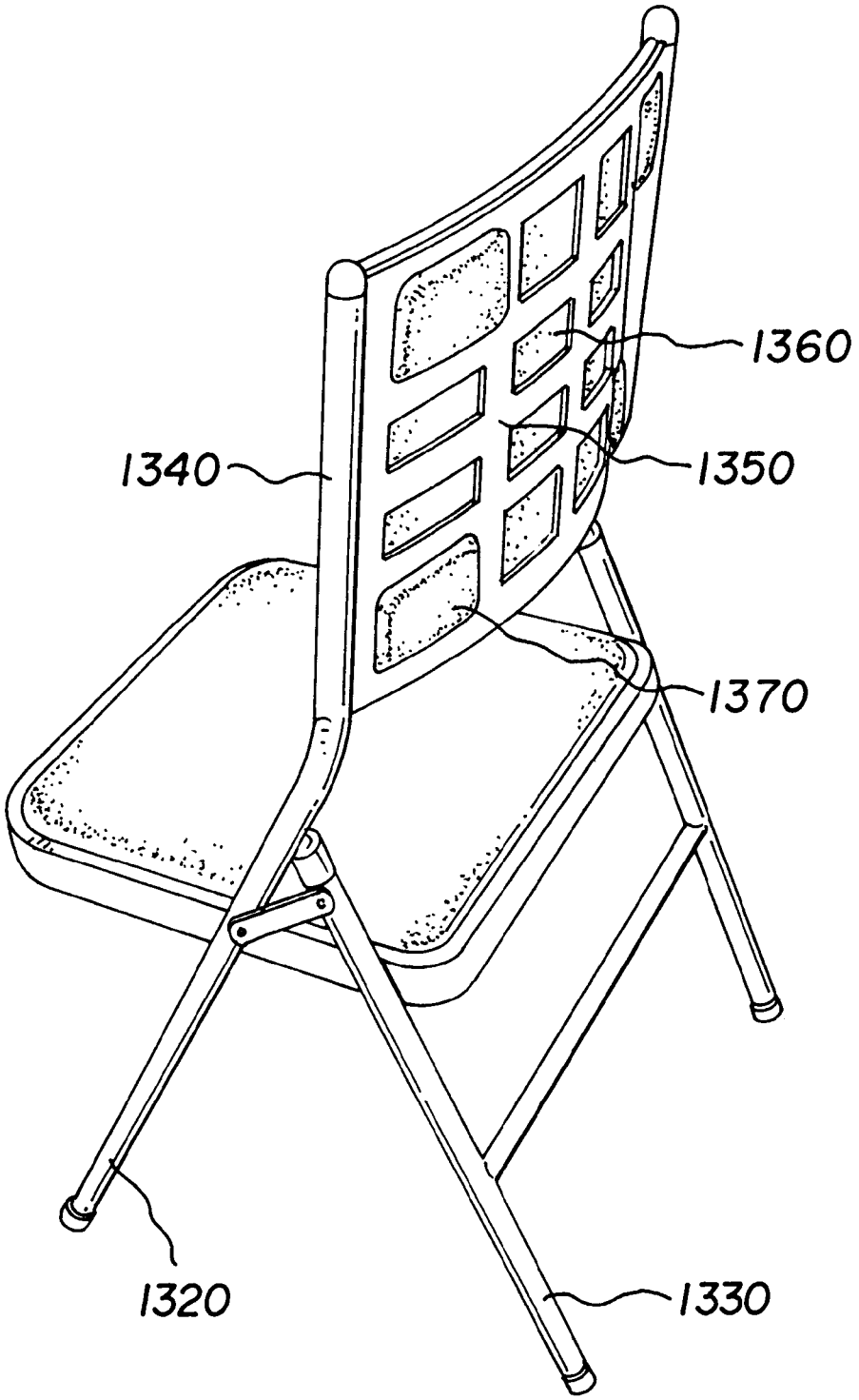
FIG. 13B illustrates a perspective view of the back of the cushioned chair shown in FIG. 13A.
Figure 13C:
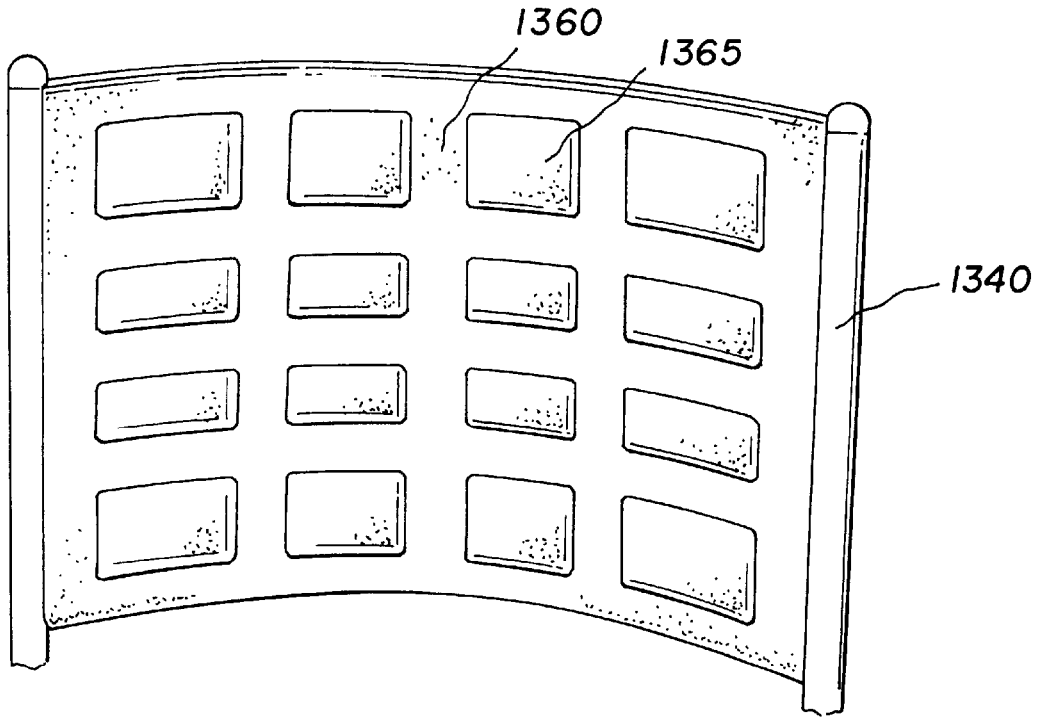
FIG. 13C illustrates a perspective view of the front of the chair back of the cushioned chair shown in FIG. 13A.
Figure 13D:
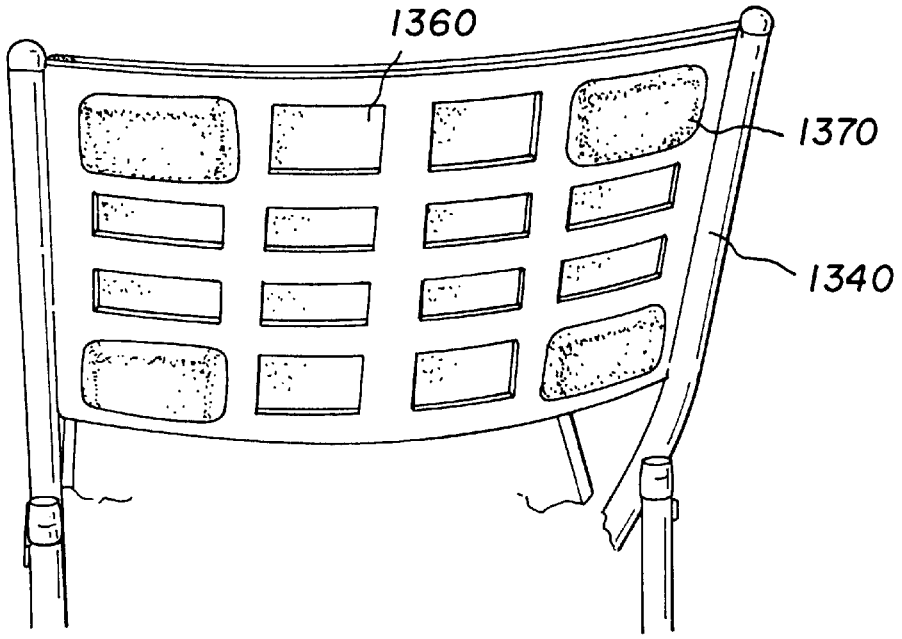
FIG. 13D illustrates a perspective view of the back of the chair back of the cushioned chair shown in FIG. 13A.

Referring to FIGS. 13A & 13B, a cushioned seat embodiment of the present invention is disclosed, with FIGS. 13C & 13D illustrating a more detailed view of the seat back of the chair illustrated in FIGS. 13A & 13B. In this particular embodiment, the chair includes seating surface 1310, parallel rear legs 1330, and parallel front legs 1320 that are integral with the seat back supports 1340 that have the bend at the predetermined height and angle. Seat back 1350 includes apertures and extends between the seat back supports 1340. The seat back cushion includes a main front section 1360, optional design elements 1365, and at least one portion or element 1370 extending from the back of the cushion to interlock with at least one of the apertures in seat back 1350.

In a preferred embodiment, the cushion is made in a molding process whereby a piece of fabric is flame bonded to a piece of foam and then heat processed in a mold to form any design elements 1360. The portions or elements 1370 on the back are made the same way and glued in place to form the necessary circumferential groove for interlocking purposes. As illustrated, the preferred embodiment has four portions or elements 1370 located at the corners, but this is not meant to be a limitation and many other configurations with various shapes, numbers of elements, and element locations are also possible.

It is not required that the cushions have a rectangular shape. The present can be embodied for cushions that having the shape of any regular or irregular polygon. The use of circular or hexagonal shaped cushions is expressly contemplated.

Further, it is contemplated that users may purchase different sets of cushions that may be used with the same chair thereby changing the chair appearance for different occasions. Further, the cushion coverings are contemplated to be removable for cleaning and replacement.

Figure 14B:
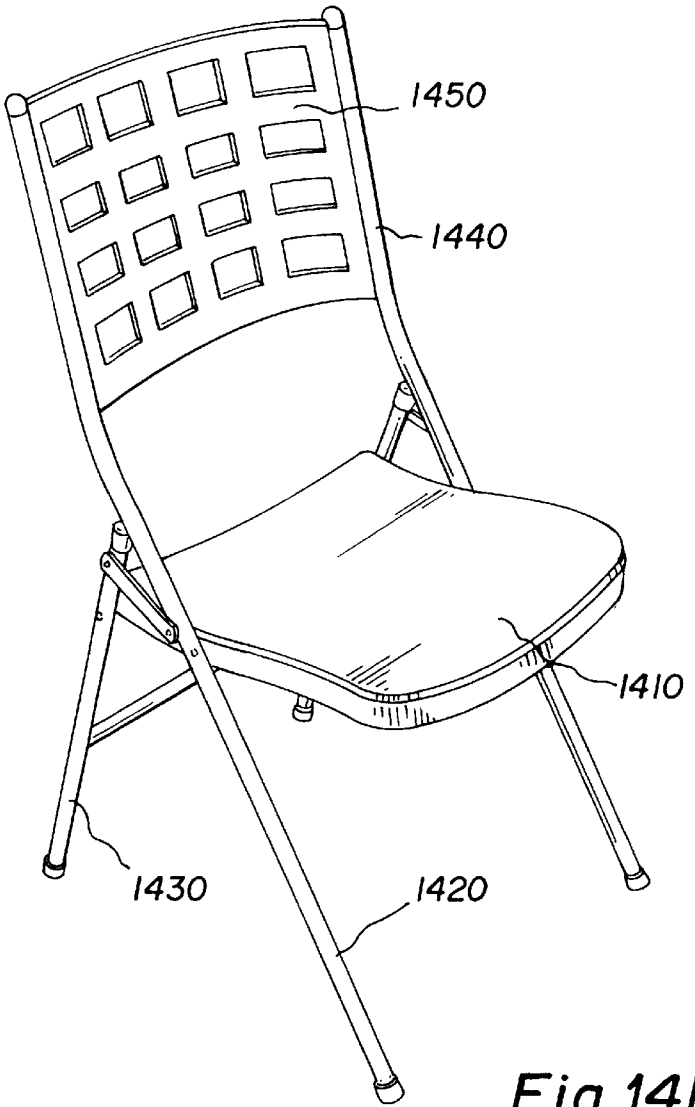
FIG. 14B illustrates a perspective view of the front of a chair according to yet another alternate embodiment of the present invention.
Figure 14A:
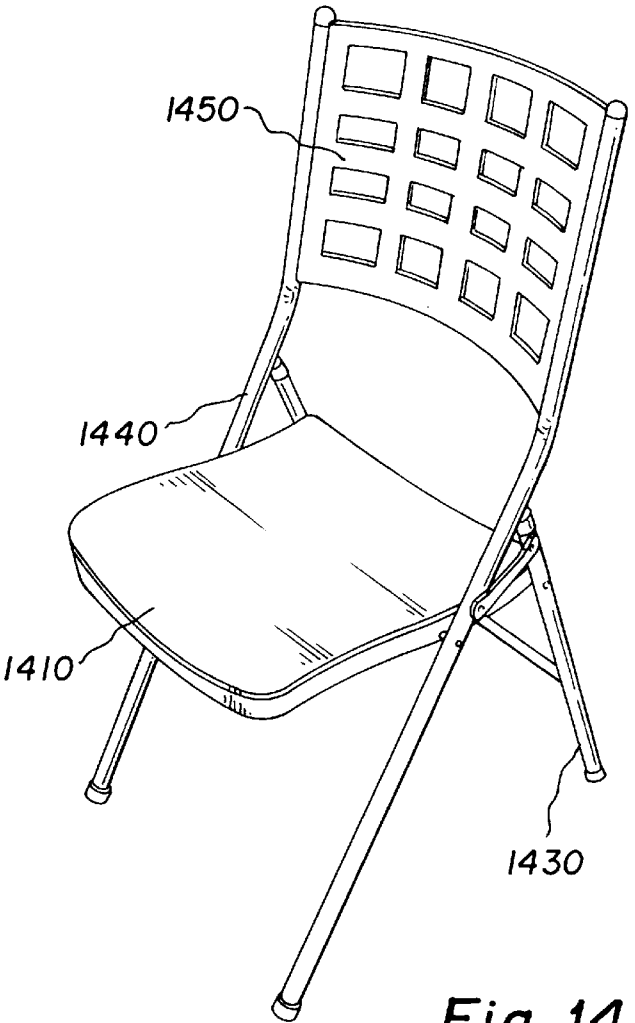
FIG. 14A illustrates a perspective view of the front of a chair according to another alternate embodiment of the present invention.

FIGS. 14A & 14B illustrate embodiments of the present invention that incorporate a contoured seating surface. As in the embodiment above, these chairs include seating surfaces 1410 and 1410', parallel rear legs 1430, and parallel front legs 1420 that are integral with the seat back supports 1440 that have the bend at the predetermined height and angle. Seat back 1450 includes apertures and extends between the seat back supports 1440. Seating surfaces 1410 and 1410' are fabric covered and bent plywood, respectively, and are contoured with a gentle, ergonomic, s-curve "waterfall" shape from front to back.

The apparatus embodiments described above are a stool and a chair. However, the present invention may be practiced advantageously by being embodied as any type of seating furniture. Chairs, stools, benches, couches, loveseats, or, plural chairs ganged together as event seating, are all examples of ways the present invention may be embodied.

The present invention has been described herein according to preferred embodiments. However, it will be understood by those of ordinary skill in the art that various modifications and improvements may be made to the described embodiments without departing from the scope of the invention as described. The scope of the invention is limited only by the appended claims.

What is claimed is:

1. A folding chair comprising:

a seating surface, a back formed by a pair of parallel seat back supports with a seat back extending therebetween, a pair of front legs extending downwardly from adjacent the seating surface substantially in parallel with one another and extending to be integral with said seat back supports; and a pair of rear legs extending downwardly from the front legs adjacent the seating surface substantially in parallel with one another;

wherein the seat back supports are bent at a pre-determined angle and at a pre-determined height above the seating surface so as to provide back support to a person seated in the folding chair, and further comprising apertures formed in said seat back and an interlocking cushion for use with the seat back, the cushion comprising:

a body formed of springy material, the body having at least one circumferential groove, wherein the at least one circumferential groove provides an interlocking fit with an aperture formed in the seat back, and wherein the body is divided by the at least one circumferential groove into a front portion and at least one back portion.

2. The folding chair of claim 1, wherein said springy material is foam that has been flame bonded to fabric and heat processed in a mold.

3. The folding chair of claim 1, further comprising plural back portions forming plural circumferential grooves for engaging plural holes formed in the chair back.

4. A folding chair comprising:

a seating surface, a back formed by a pair of parallel seat back supports with a seat back extending therebetween, a pair of front legs extending downwardly from adjacent the seating surface substantially in parallel with one another and extending to be integral with said seat back supports; and a pair of rear legs extending downwardly from the front legs adjacent the seating surface substantially in parallel with one another; wherein the seat back supports are bent at a pre-determined angle and at a pre-determined height above the seating surface so as to provide back support to a person seated in the folding chair, and further comprising an interlocking cushion for use with a chair back, the cushion comprising:

a body formed of springy material, the body being divided into a main portion and plural interlock portions;

wherein the main portion has a substantially flat back and the plural interlock portions are disposed spaced from one another across the back of the main portion; and wherein each of the interlock portions provides an interlocking fit with a corresponding hole formed in the chair back.

5. The folding chair of claim 4, wherein the interlocking cushion further comprises:

a removable front cover substantially surrounding the main portion, and plural removable back covers substantially surrounding each of the interlock portions.

6. The folding chair of claim 4, wherein said springy material is foam that has been flame bonded to fabric and heat processed in a mold.

7. The folding chair of claim 2 or 5 further comprising said seating surface being contoured with a gentle s-shape from front to back.

8. The folding chair of claim 7, wherein an upper surface of said seating surface is formed from plywood.

9. The folding chair of claim 7, wherein an upper surface of said seating surface is fabric covered.

10. An interlocking cushion for use with a chair back, the cushion comprising:

a body formed of springy material, the body being divided into a main portion and plural interlock portions;

wherein the main portion has a substantially flat back and the plural interlock portions are disposed spaced from one another across the back of the main portion; and wherein each of the interlock portions provides an interlocking fit with a corresponding hole formed in the chair back.

11. The folding chair of claim 10, wherein the interlocking cushion further comprises:

a removable front cover substantially surrounding the main portion, and plural removable back covers substantially surrounding each of the interlock portions.

12. The folding chair of claim 10, wherein said springy material is foam that has been flame bonded to fabric and heat processed in a mold.

* * * * *